US009578980B1

(12) United States Patent
Freeman

(10) Patent No.: US 9,578,980 B1
(45) Date of Patent: Feb. 28, 2017

(54) DEVICE TO AID HANGING OF OBJECTS ON AN UPRIGHT SURFACE

(71) Applicant: Joseph Neal Freeman, Pike Road, AL (US)

(72) Inventor: Joseph Neal Freeman, Pike Road, AL (US)

( * ) Notice: Subject to any disclaimer, the term of this patent is extended or adjusted under 35 U.S.C. 154(b) by 97 days.

(21) Appl. No.: 14/698,518

(22) Filed: Apr. 28, 2015

(51) Int. Cl.
*A47G 1/24* (2006.01)
*A47G 1/20* (2006.01)

(52) U.S. Cl.
CPC ..... *A47G 1/205* (2013.01)

(58) Field of Classification Search
CPC ..... A47G 1/205
USPC ..... 33/613
See application file for complete search history.

(56) References Cited

U.S. PATENT DOCUMENTS

| | | | | |
|---|---|---|---|---|
| 4,220,309 | A | 9/1980 | Eisen et al. | |
| 4,336,884 | A * | 6/1982 | Hart | A47G 1/205 206/575 |
| 4,457,485 | A * | 7/1984 | Landt | B25H 7/04 248/542 |
| 4,637,583 | A * | 1/1987 | Babitz | A47G 1/205 248/497 |
| 5,240,287 | A * | 8/1993 | Nirmel | A47G 1/205 283/101 |
| 6,574,880 | B2 | 6/2003 | Lombardo | |
| 6,782,633 | B1 * | 8/2004 | Cedrone | A47G 1/205 33/562 |
| 6,898,862 | B1 * | 5/2005 | Oberst | A47G 1/205 33/574 |
| 7,185,442 | B2 | 3/2007 | Grillo | |
| 7,275,334 | B2 | 10/2007 | Horst | |
| 7,350,312 | B1 | 4/2008 | Grillo | |
| 7,487,598 | B2 * | 2/2009 | Krachtus | G01C 11/00 33/613 |
| 8,424,217 | B2 * | 4/2013 | Murray | G01C 9/02 33/347 |
| 2002/0148134 | A1 | 10/2002 | Meyer et al. | |
| 2008/0092401 | A1 | 4/2008 | Holcombe | |
| 2013/0318808 | A1 | 12/2013 | Howe et al. | |

FOREIGN PATENT DOCUMENTS

| | | | |
|---|---|---|---|
| BE | 1007784 | 10/1995 | |
| DE | 4103147 | 8/1992 | |
| DE | 4303318 | 8/1994 | |
| DE | 102004002941 A1 * | 8/2005 | A47G 1/205 |
| DE | 102007016125 | 3/2007 | |
| WO | 8402103 | 6/1984 | |

* cited by examiner

*Primary Examiner* — Christopher Fulton
(74) *Attorney, Agent, or Firm* — Bradley Arant Boult Cummings LLP

(57) ABSTRACT

A device and method for locating a hanger for an object on a vertical surface, in which an elongated strip with a breakpoint of reduced tensile strength indicates the precise point for placing the hanger. The elongated strip is adhered to the rear of the object such that the breakpoint or other marker aligns with the top of the D-hook, bracket, wire, or keyhole slot. The object is positioned on the wall and a downward pressure breaks the strip leaving an indication of where the hanger should be placed.

25 Claims, 4 Drawing Sheets

DEVICE TO AID HANGING OF OBJECTS ON AN UPRIGHT SURFACE

TECHNICAL FIELD

This disclosure relates generally to devices used to aid hanging pictures, art, or other items which are secured to a wall or surface.

BACKGROUND

Hanging pictures, mirrors or artwork can be a challenging problem for many individuals. Hanging pictures (or other such items) generally involves making multiple measurements of the picture and wall to determine the correct placement of the hanger. Picture wire has slack that must be tensioned to determine the appropriate location of a hanger. The use of two or more brackets or keyhole slots on the picture can allow a more secure attachment, but poses additional problems for measuring and ensuring levelness if the brackets or keyholes are unevenly positioned on the picture. Errors in measurement can lead to the need to repeat the process of measuring and securing the hanger, which results in damage to the walls.

Thus, there is a need for a simple device which allows an individual to accurately place hangers for a picture or other such items, regardless of whether the brackets or other mounting devices on the picture are evenly aligned. Such a device minimizes the time and effort required to hang a picture and may eliminate the need for taking measurements.

SUMMARY

Embodiments of the present invention satisfy these needs, but it should be noted that not all embodiments may satisfy each need. One embodiment comprises a device for locating a hanger on a surface, comprising an elongated strip having a front surface and a rear surface and a proximal portion and a distal portion with a breakpoint between said portions, a first adhesive disposed on at least a part of the front surface or the rear surface of the proximal portion of the strip; and a second adhesive disposed on, at least a part of the front surface or rear surface of the distal portion of the elongated strip, wherein an adhesive force of each of the first adhesive and the second adhesive is greater than a tensile strength of the breakpoint.

Another embodiment comprises a device for locating a hanger on a surface, comprising an elongated paper strip having a front surface and a rear surface and a proximal portion and a distal portion with a breakpoint between said portions, wherein the paper strip has a first width, and the breakpoint comprises a second width that is less than the first width, and wherein the first width tapers to the second width; a first adhesive disposed on at least a part of the front surface of the proximal portion of the strip; and a second adhesive disposed on at least a part of the rear surface of the distal portion of the elongated strip; wherein an adhesive force of each of the first adhesive and the second adhesive is greater than a tensile strength of the breakpoint.

Another embodiment comprises a device for positioning a hanger to a surface, comprising, an elongated strip having a front surface and a rear surface and a proximal portion and a distal portion with a breakpoint between said portions, an adhesive disposed on at least a part of the front surface of the proximal portion of the strip, and wherein an adhesive force of the adhesive is greater than a tensile strength of the breakpoint.

Another embodiment comprises a method for locating a hanger for an object comprising passing a proximal portion of an elongated strip through a hanging device on a rear surface of the object, aligning a breakpoint of the elongated strip with a top edge of the hanging device; folding the elongated strip at the breakpoint and adhering the proximal portion to an adjacent region of a distal portion, pulling the distal portion of the elongated strip above a top edge of the object while placing the object against the vertical surface in a desired position, and applying downward force sufficient to shear the elongated strip at the breakpoint.

BRIEF DESCRIPTION OF THE DRAWINGS

The present invention will be explained, by way of example only, with reference to certain embodiments and the attached figures, in which.

DETAILED DESCRIPTION

Figure 1A:
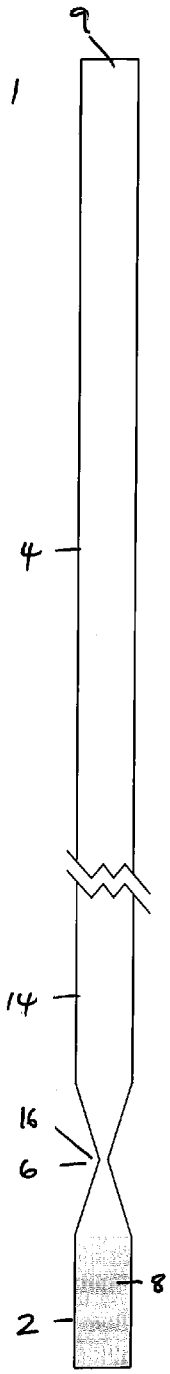
FIG. 1A is a front view of one embodiment of the present invention.
Figure 1B:
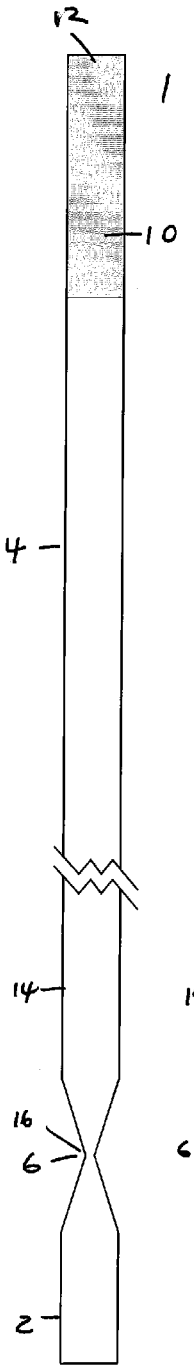
FIG. 1B is a rear view of the embodiment of FIG. 1A.

FIGS. 1-4 will be used as reference to describe certain embodiments of the present invention. FIGS. 1-4 are illustrative in nature and are not meant to the limit the present invention to the embodiments illustrated.

Embodiments of the present invention provide an elongated strip for accurately placing hangers for pictures and a method for using said device. Although this disclosure refers to use of the device and method with hanging pictures, it will be understood that the device and method are equally applicable to other items which may require the placement of hangers to secure them to the wall or other vertical surface. As used herein, a picture may include a framed or unframed picture, painting, photograph, canvas, tapestry or other artwork, a mirror, plaque, certificate, shadow box, display, collectors' item, and any other similar object that may be hung from a wall or other vertical or upright surface with a hanger that is at least partially inaccessible or obscured from view when the object is in the desired position on the surface. As used herein, a hanger may include a nail, screw, a screw and anchor, toggle bolt, or other fastener or similar device known in the art that may be attached or driven into a wall or other vertical surface for hanging a picture.

In one embodiment (FIG. 1), the device comprises an elongated strip 1 divided into a proximal portion 2 and a distal portion 4 by a break point 6. There is an adhesive 8 disposed on at least a part of either the front 9 or rear 12 surface of the proximal portion 2 and an adhesive 10 disposed on at least a part of either the front 9 or rear 12 surface of the distal portion 4. It will be appreciated that the terms front and rear define the opposite surfaces of the strip with respect to one another and are used for convenience in identifying these surfaces relative to one another in a given embodiment. Therefore, if a first side is designated the "front," the opposite side is the rear; if that first side were designated the "rear," the opposite side would be the "front." The adhesive may be a pressure sensitive adhesive or any other suitable adhesive. (As explained below, the proximal portion 2 is folded to bring the adhesive into contact with an adjacent region of the distal portion 4, and thus the adhesive 8 can be disposed either surface of the proximal portion 2, depending on which way the strip is intended to be folded.)

In one embodiment (FIGS. 1-2), the breakpoint 6 is created by an hourglass shape where the width of the strip 14 tapers to a narrower width 16 creating a point of lesser tensile strength in the strip 1 that will break first, before any other portion of the strip, with an application of a mechanical force. This configuration of the breakpoint 6 has the advantage of leaving an arrow-shaped end on the strip 1 which shows the precise location for placement of the hanger. In another embodiment (FIGS. 3-4), the strip 1 is of a uniform width and the breakpoint 6 is created by perforation of the strip 1. A perforation can also be applied to the narrower width 16 when the strip 1 is tapered. A breakpoint 6 also may be created by the use of materials with different tensile strengths in constructing the strip, or otherwise altering the tensile strength of a part of the strip (as with a perforation). It will be appreciated that other ways of creating a portion of the elongated strip 1 having a lesser tensile strength may be used to create the breakpoint 6 of the device.

In one embodiment, the device comprises an elongated strip of paper, although it will be readily understood that other materials may be used so long as they allow the elongated strip 1 to break at the breakpoint 6 when appropriate force is applied. In yet another embodiment shown in FIGS. 3-4, the proximal portion 2 of the strip comprises a hole, aperture, or mark 18 located above the breakpoint 6, such that the aperture or mark 18 is intended to mark the location of the hanger (rather than the breakpoint 6 itself, as described below). In this embodiment, therefore, the breakpoint 6 may comprise a region of the strip 1 rather than a defined point.

Figures 2A, 2B, 2C, 2D, 2E, 2F:
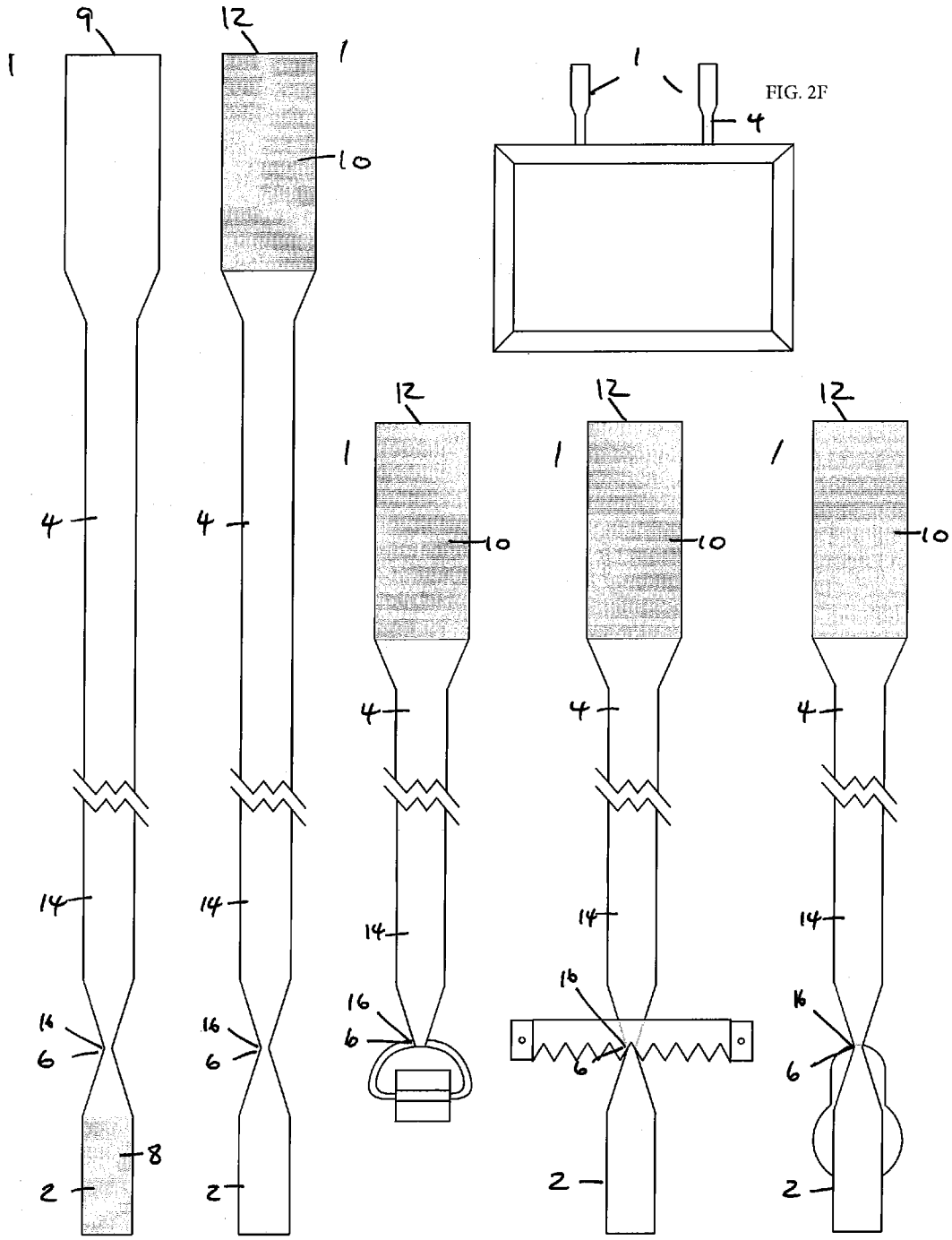
FIG. 2A is a front view of an alternative embodiment of the present invention.
FIG. 2B is a rear view of the embodiment of FIG. 2A.
FIG. 2C shows the embodiment of FIG. 2A positioned for use with a object having a D-ring.
FIG. 2D shows the embodiment of FIG. 2A positioned for use with a object having a bracket.
FIG. 2E shows the embodiment of FIG. 2A positioned for use with a object having keyhole slot.
FIG. 2F shows the embodiment of FIG. 2A positioned against a vertical surface with an object to be hung.
Figures 3A, 3B, 3C, 3D, 3E, 3F:
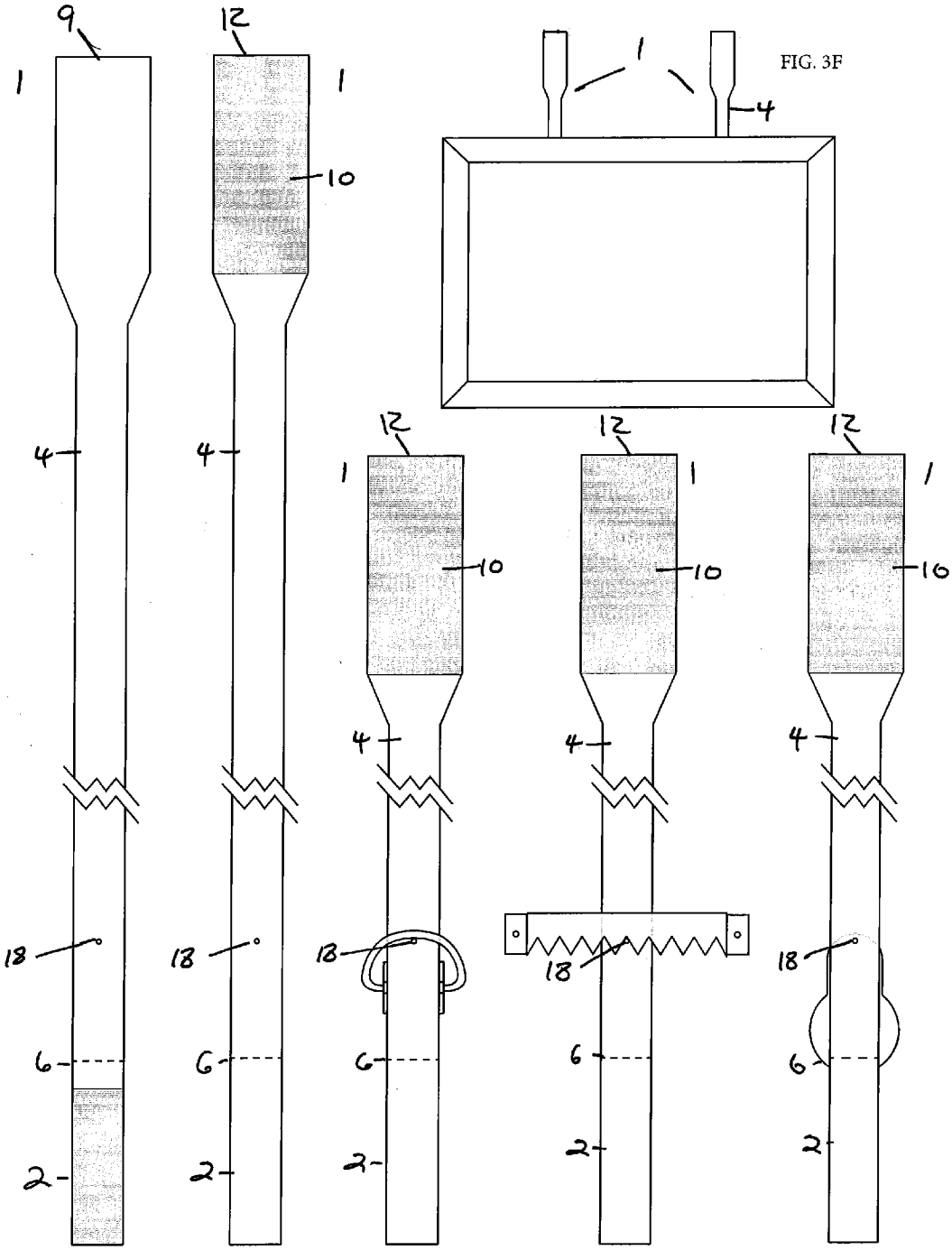
FIG. 3A is a front view of an alternative embodiment of the present invention.
FIG. 3B is a rear view of the embodiment of FIG. 3A.
FIG. 3C shows the embodiment of FIG. 3A positioned for use with a object having a D-ring.
FIG. 3D shows the embodiment of FIG. 3A positioned for use with a object having a bracket.
FIG. 3E shows the embodiment of FIG. 3A positioned for use with a object having keyhole slot.
FIG. 3F shows the embodiment of FIG. 3A positioned against a vertical surface with an object to be hung.
Figure 4A:
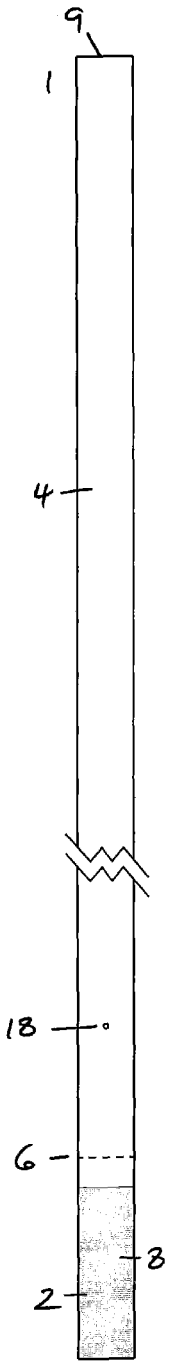
FIG. 4A is a front view of an alternative embodiment of the present invention.
Figure 4B:
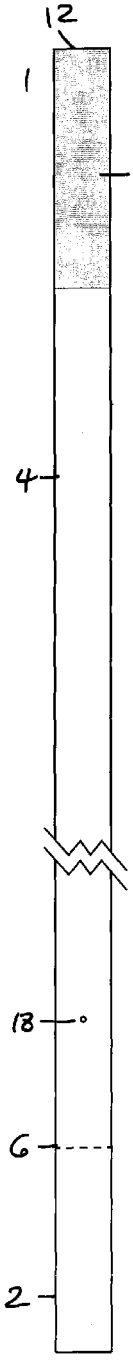
FIG. 4B is a rear view of the embodiment of FIG. 4A.
Figure 4C:
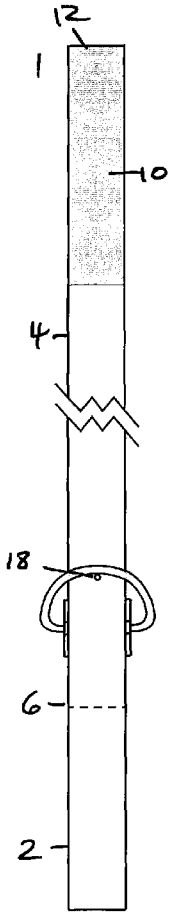
FIG. 4C shows the embodiment of FIG. 4A positioned for use with a object having a D-ring.
Figure 4D:
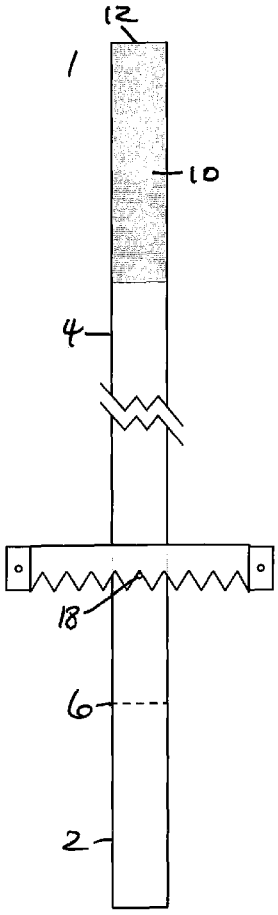
FIG. 4D shows the embodiment of FIG. 4A positioned for use with a object having a bracket.
Figure 4E:
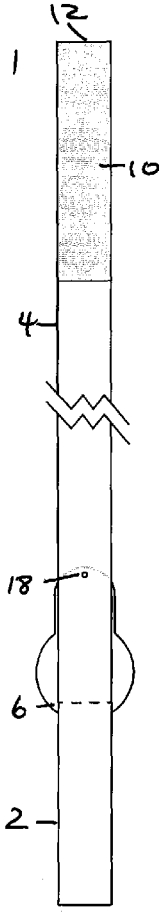
FIG. 4E shows the embodiment of FIG. 4A positioned for use with a object having keyhole slot.
Figure 4F:
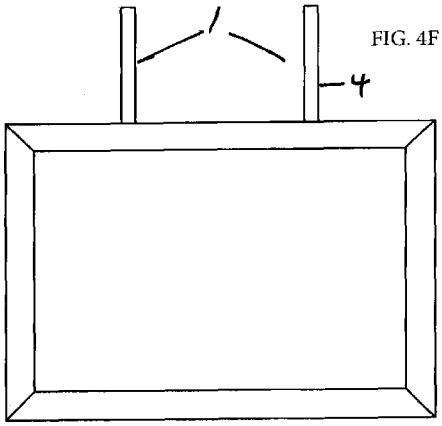
FIG. 4F shows the embodiment of FIG. 4A positioned against a vertical surface with an object to be hung.

In one embodiment, the adhesive 8 located on the proximal portion 2 and the adhesive 10 located on the distal portion 4 of the elongated strip 1 are the same. In another embodiment, the adhesive 8 located on the proximal portion 2 has a greater adhesive strength than the adhesive 10 located on the distal portion 4 of the elongated strip. In another embodiment, an adhesive 8 is disposed only on the proximal portion of the strip. In any embodiment, an adhesive portion may be covered with a removable protective film to preserve the adhesive until the elongated strip is used. A part of the strip on which the adhesive is disposed (as well as, in the case of the distal portion, the region to which the adhesive part of the proximal portion is to adhere when folded, in some embodiments) may have an increased width to increase the adhesive's holding strength (FIGS. 2 and 3).

Figure 1F:
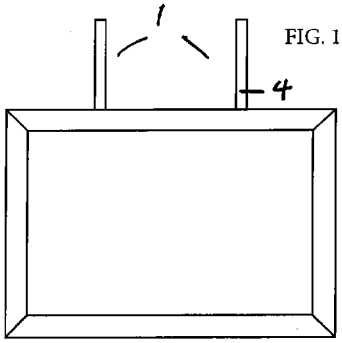
FIG. 1F shows the embodiment of FIG. 1A positioned against a vertical surface with an object to be hung.

The strip 1 preferably should be long enough such that when in use (as described below) its distal portion 4 extends beyond the top edge of the picture so that the adhesive portion 10 may be more easily positioned against the wall or vertical surface (FIG. 1F). The length of the distal portion 4 may be varied depending upon the size of the picture to be hung. For a smaller item, it may be preferable and easier to handle an elongated strip 1 with a relatively short distal portion 4 that extends beyond the edge of the picture only a short distance. For a larger item, a longer distal portion 4 will be required to ensure that the strip 1 is long enough to extend beyond the edge of the picture so that the individual may secure it to the wall. Generally, the length of the distal portion 4 should exceed that of the proximal portion 2. In some embodiments, the length of the distal portion 4 will be at least twice the length of the proximal portion 2. In other embodiments, the length of the distal portion 4 will be at least five or ten times greater than the length of the proximal portion 2.

Figure 1C:
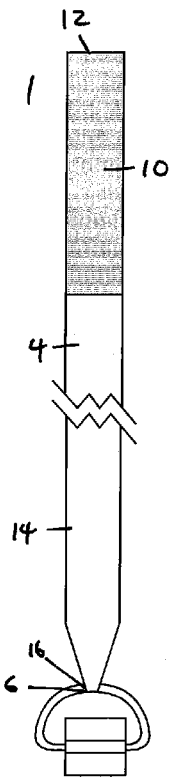
FIG. 1C shows the embodiment of FIG. 1A positioned for use with a object having a D-ring.
Figure 1D:
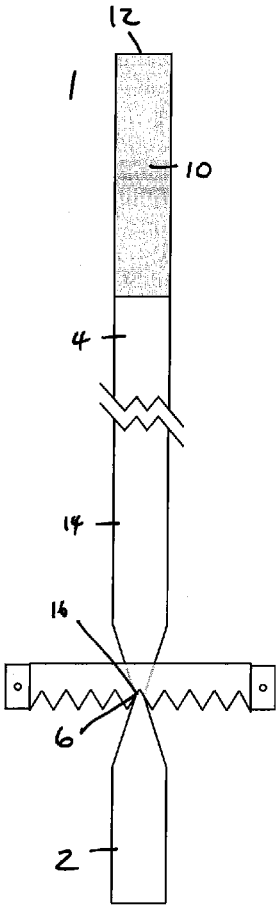
FIG. 1D shows the embodiment of FIG. 1A positioned for use with a object having a bracket.
Figure 1E:
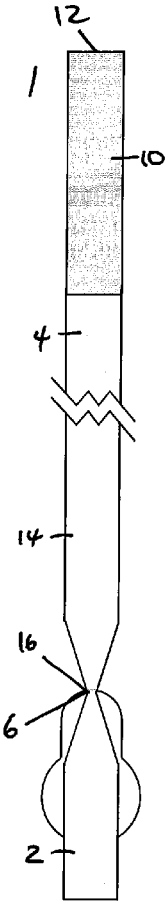
FIG. 1E shows the embodiment of FIG. 1A positioned for use with a object having keyhole slot.

In one embodiment of the method of using the device, an individual wishing to hang a picture with one or more "D" rings or brackets on the rear may position the picture on a table or other surface to expose or access the D-rings or brackets. An elongated strip 1 is placed face-down and the proximal portion 2 threaded through the bracket from top to bottom. The elongated strip 1 is folded at the breakpoint 6 with the fold against the top of the D-ring, bracket, or other annular structure included on the picture for hanging (FIGS. 1C and 2C). The proximal portion 2 and an adjacent region of the distal portion 4 are aligned, and the adhesive 8 on the proximal portion 2 is used to secure the portions together. In this configuration, the breakpoint 6 of the elongated strip 1 is located precisely at the top of the bracket. This process is repeated for each bracket. The distal portions 4 of the elongated strips 1 are straightened and pulled beyond the top edge of the picture while the picture is located on the wall in the desired position. The distal portions 4 of the elongated strips 1 are pulled taut. They do not need to be precisely plumb, but better results may be achieved when they are oriented generally vertically. The adhesive 10 on the distal portions 4 of the elongated strips 1 is used to secure them to the wall. The individual then applies downward pressure on the picture and the elongated strips 1 break at the breakpoint 6. The picture is removed temporarily. The elongated strips 1 remain adhered to the wall, with the breakpoint 6 indicating the location for the installation of the hanger. The hanger is installed on the wall. The elongated strip 1 is removed from the wall and the picture is mounted on the hanger.

In another embodiment, the disclosed device is used to hang a picture with picture wire. An elongated strip 1 as disclosed and claimed herein is placed face-down with the proximal portion 2 toward the bottom edge of the picture and aligned with the center of frame (or location of the center of gravity of the picture if it is off-center horizontally). The elongated strip 1 is folded at the breakpoint 6 enclosing the wire between the two ends. The proximal portion 2 and an adjacent region of the distal portion 4 are aligned, and the adhesive 8 on the proximal portion 2 is used to secure the portions together. In this configuration, the breakpoint 6 of the elongated strip 1 is located at the top center of the wire. The distal portion 4 of the elongated strip 1 is straightened and pulled preferably beyond the top edge of the picture while the picture is located on the wall in the desired position. The distal portion 4 of the elongated strip 1 is pulled taut. The adhesive 10 on the distal portion 2 of the elongated strip 1 is used to secure it to the wall. The individual then applies downward pressure on the picture and the elongated strip 1 breaks at the breakpoint 6. The picture is removed to a secure location temporarily. The elongated strip 1 remains adhered to the wall, with the breakpoint 6 indicating the precise location for the installation of the hanger. The hanger is installed. The elongated strip 1 is removed from the wall and the picture is mounted on the hanger.

In another embodiment, the disclosed device is used to hang a picture with one or more brackets or keyhole slots carved into the frame (FIGS. 1D-E and 2D-E). In this embodiment, the individual places the picture on a table or other surface to expose or access the brackets or keyhole slots. The elongated strip 1 is placed with the adhesive 8 on the proximal portion 2 facing the back of the picture. The breakpoint 6 of the elongated strip 1 is aligned to the top, center of the bracket or keyhole slot. The elongated strip 1 is secured to the picture by pressing the adhesive portion 8 onto the picture. This process is repeated for each bracket or keyhole slot. The distal portions 4 of the elongated strip 1 are straightened and pulled beyond the top edge of the picture while the picture is located on the wall in the desired position. The distal portions 4 of the elongated strips 1 are pulled taut. The adhesive 10 on the distal portions 4 of the elongated strips 1 is used to secure them to the wall. The individual then applies downward pressure on the picture and the elongated strip 1 breaks at the breakpoint 6. The picture with the attached proximal portions 2 of the elongated strip 1 is removed to a secure location temporarily. The distal portion 4 of the elongated strip 1 remains attached to the wall, with the breakpoint 6 indicating the precise location for the installation of the hanger. The hanger is installed. The distal portion 6 of the elongated strip 1 is removed from the wall. The proximal portion 2 of the elongated strip 1 is removed from the picture, and the picture is mounted on the hanger.

A similar method is used with the embodiment shown in FIGS. 3-4 that uses a hole, aperture, or mark 18 to mark the location of the hanger, rather than the breakpoint. With this embodiment, the aperture or mark 18 is aligned with the keyhole slot (or bracket or D-ring, if used with pictures have that hardware), with the breakpoint 6 below. The process otherwise follows the steps described above, such that after the strip 1 breaks at the breakpoint 6, the aperture or mark 18 identifies the location of the hanger, rather than the breakpoint 6.

In another embodiment of the device, a strip 1 with an adhesive portion 8 only on the proximal portion 2 may be used by two individuals to install a hanger. Rather than using adhesive 10 on the distal portion 4 to secure the strip 1 to the wall when the picture is located in the desired position, a second individual simply holds the distal portion 4 in place while force is applied to the strips 1 and they are broken.

It will be appreciated that the methods disclosed in these embodiments are general descriptions which may be applied to any type of hanger and may be used with any type of bracket, D-hook, wire, keyhole slot, or other mechanism known in the art. Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A device for locating a hanger on a surface, comprising:

a. an elongated strip having a front surface and a rear surface and a proximal portion and a distal portion with a breakpoint between said portions;

b. a first adhesive disposed on at least a part of the front surface of the proximal portion of the strip; and c. a second adhesive disposed on at least a part of the front surface or the rear surface of the distal portion of the elongated strip;

d. wherein an adhesive force of each of the first adhesive and the second adhesive is greater than a tensile strength of the breakpoint.

2. The device of claim 1, wherein the adhesive force of the first adhesive is greater than that of the second adhesive.

3. The device of claim 1, wherein the strip has a first width, and the breakpoint comprises a second width that is less than the first width.

4. The device of claim 3, wherein the first width tapers to the second width.

5. The device of claim 3, wherein the breakpoint comprises a perforation.

6. The device of claim 1, wherein the breakpoint comprises a perforation.

7. The device of claim 1, wherein the distal portion of the elongated strip is longer than the proximal portion.

8. The device of claim 1, further comprising an indicator located on the distal portion of the elongated strip proximate the break point.

9. The device of claim 8, wherein said indicator comprises an aperture.

10. The device of claim 8, wherein said indicator comprises a mark.

11. The device of claim 8, wherein said breakpoint comprises a perforation.

12. The device of claim 1, wherein said second adhesive is disposed on the rear surface of the distal portion.

13. The device of claim 1, wherein the part of the distal portion on which the second adhesive is disposed has a width greater than another part of the distal portion.

14. A device for locating a hanger on a surface, comprising:

a. an elongated paper strip having a front surface and a rear surface and a proximal portion and a distal portion with a breakpoint between said portions, wherein the paper strip has a first width, and the breakpoint comprises a second width that is less than the first width, and wherein the first width tapers to the second width;

b. a first adhesive disposed on at least a part of the front surface of the proximal portion of the strip; and c. a second adhesive disposed on at least a part of the rear surface of the distal portion of the elongated strip;

d. wherein an adhesive force of each of the first adhesive and the second adhesive is greater than a tensile strength of the breakpoint.

15. The device of claim 14, wherein the adhesive force of the first adhesive is greater than that of the second adhesive.

16. The device of claim 14, wherein the breakpoint further comprises a perforation.

17. A device for positioning a hanger to a surface, comprising:

a. an elongated strip having a front surface and a rear surface and a proximal portion and a distal portion with a breakpoint between said portions;

b. an adhesive disposed on at least a part of the front surface of the proximal portion of the strip; and c. wherein an adhesive force of the adhesive is greater than a tensile strength of the breakpoint.

18. A method for locating a hanger for an object comprising:

a. attaching an elongated strip having a breakpoint to a rear side of an object to be hung;

b. pulling a distal portion of the elongated strip above a top edge of the object while placing the object against a vertical surface in a desired position; and c. applying downward force sufficient to shear the elongated strip at the breakpoint.

19. The method of claim 18, wherein said object has a hanging device on a rear side and wherein said attaching step comprises:

a. passing a proximal portion of the elongated strip through said hanging device;

b. aligning the breakpoint of the elongated strip with a top edge of the hanging device;

c. folding the elongated strip at the breakpoint and adhering the proximal portion to an adjacent region of the distal portion.

20. The method of claim 19, further comprising adhering a second adhesive portion on a rear surface of the distal portion of the elongated strip to the vertical surface, wherein the elongated strip remains adhered to the vertical surface after the elongated strip is sheared.

21. The method of claim 19, wherein the hanging device comprises one of a bracket, a D-ring, or a wire.

22. The method of claim 18, wherein said attaching step further comprises adhering to a rear surface of the rear side of the object a first adhesive portion on a front surface of a proximal portion of the elongated strip.

23. The method of claim 22, further comprising, before said adhering step, aligning the breakpoint of the elongated strip with a top edge of a hanging device on the rear surface of the rear side of the object.

24. The method of claim 23, further comprising adhering a second adhesive portion on a rear surface of the distal portion of the elongated strip to the vertical surface, wherein the elongated strip remains adhered to the surface after the elongated strip is sheared.

25. The method of claim 22, wherein said elongated strip comprises an aperture or mark on the distal portion of said strip proximate the breakpoint, and further comprising, before said adhering step, aligning said aperture or mark with a top edge of a hanging device on a rear surface of the object.

* * * * *